US009415780B2

(12) United States Patent
Gustafson

(10) Patent No.: US 9,415,780 B2
(45) Date of Patent: Aug. 16, 2016

(54) ZIP LINE ATTRACTION AND METHODS

(71) Applicant: Steven R. Gustafson, Rockford, IL (US)

(72) Inventor: Steven R. Gustafson, Rockford, IL (US)

(73) Assignee: Experience Based Learning, Inc., Rockford, IL (US)

( * ) Notice: Subject to any disclaimer, the term of this patent is extended or adjusted under 35 U.S.C. 154(b) by 288 days.

(21) Appl. No.: 14/134,547

(22) Filed: Dec. 19, 2013

(65) Prior Publication Data

US 2014/0182477 A1 Jul. 3, 2014

Related U.S. Application Data

(60) Provisional application No. 61/746,661, filed on Dec. 28, 2012.

(51) Int. Cl.
*B61B 7/00* (2006.01)
*A63G 21/20* (2006.01)
*B61B 7/06* (2006.01)

(52) U.S. Cl.
CPC . *B61B 7/00* (2013.01); *A63G 21/20* (2013.01); *B61B 7/06* (2013.01)

(58) Field of Classification Search
CPC ..... B61B 7/00; B61B 7/04; B61B 7/06; A63G 21/20; A63G 21/22
USPC ..... 104/79, 113, 116
See application file for complete search history.

(56) References Cited

U.S. PATENT DOCUMENTS

| | | | | |
|---|---|---|---|---|
| 378,154 | A * | 2/1888 | Van Zandt | A63G 21/22 104/113 |
| 403,603 | A * | 5/1889 | Newcomb | B66C 1/62 104/113 |
| 837,480 | A * | 12/1906 | Lee | B66C 1/62 104/113 |
| 952,673 | A * | 3/1910 | Karr | A63G 3/00 104/113 |
| 1,422,032 | A * | 7/1922 | Chapman | A63G 21/20 104/113 |
| 8,708,109 | B2 * | 4/2014 | Steele | A63G 21/22 104/113 |
| 2008/0011183 | A1 * | 1/2008 | Fischer | A63G 21/22 104/123 |

* cited by examiner

*Primary Examiner* — Zachary Kuhfuss
(74) *Attorney, Agent, or Firm* — Reinhart Boerner Van Deuren P.C.

(57) ABSTRACT

A zip line attraction and methods are provided. The zip line attraction includes a tower and a stopping point. One or more cables extend between the tower and the stopping point. At least one end of the cable can change in elevation to allow users to travel from the tower to the stopping point, and back to the tower from the stopping point without disconnecting from the cable.

13 Claims, 4 Drawing Sheets

ZIP LINE ATTRACTION AND METHODS

CROSS-REFERENCE TO RELATED PATENT APPLICATIONS

This patent application claims the benefit of U.S. Provisional Patent Application No. 61/746,661. filed Dec. 28, 2012. the entire teachings and disclosure of which are incorporated herein by reference thereto.

FIELD OF THE INVENTION

This invention generally relates to recreational attractions, and more specifically to zip line attractions.

BACKGROUND OF THE INVENTION

Zip line attractions continue to grow in popularity. Contemporary zip line attractions typically involve one or more cables which extend between towers. Each tower has at least one platform. The cable that extends from one tower to the other is connected at its ends, respectively, to each tower above and in proximity to the platform of that tower. User's connect to the cable while standing on the platform, depart from the platform, travel along the cable in a harness, and arrive at the platform of another tower. Such attractions may involve two towers, or more than two towers in what is referred to in the art as a tour.

In the two tower configuration, a user is connected to the cable extending between the towers via their harness. The user then departs from one tower and rides along the cable to the other tower. After arriving at the other tower, the user is disconnected from the cable, and the ride is over. Such attractions, while enjoyable and successful in the industry, can lead to long queues as waiting users must wait for each person to attach, ride, and detach from the cable. This can lead to user dissatisfaction, when considering the waiting time versus the actual ride time.

To avoid such user dissatisfaction, the so called tours that employ multiple towers allow users to successively ride from tower to tower, thereby lengthening their overall ride time. More specifically, a user begins at one tower, rides to the next tower, then disconnects from their current cable and connects to another cable to ride to another tower, and so on until the course is complete. Such tours are typically outdoors, and the towers are typically arranged in a non-linear fashion to give users a sense of variety.

As can be readily appreciated, a tour configuration with its multiple tower arrangement requires a considerable amount of acreage. Unfortunately, many recreational establishments cannot accommodate a tour configuration given their relatively limited outdoor space. As a result, these establishments have been heretofore unable to employ a zip line tour, and must either 1) resort to a two tower configuration despite its drawbacks as discussed above, or 2) forego their aspirations of employing a zip line attraction entirely. In view of these constraints, there is a need in the art for a zip line attraction that provides extended ride time to thereby increase user satisfaction, but not require the relatively large amount of real estate required in a tour configuration.

The invention provides such a zip line attraction. These and other advantages of the invention, as well as additional inventive features, will be apparent from the description of the invention provided herein.

BRIEF SUMMARY OF THE INVENTION

In one aspect, the invention provides a zip line attraction that provides relatively longer ride times with a minimal space requirement. A zip line attraction according to this aspect includes a first tower extending from a base surface, a first cable, and a stopping point. The first cable is connected at one end to the first tower and at another end to the stopping point. At least one end of the cable is movable in elevation relative to the base surface such that a user situated on the cable can depart from the first tower, travel along the first cable, and arrive at the stopping point and subsequently depart from the stopping point, travel along the first cable, and arrive at the first tower without disconnecting from the cable between traveling from the first tower to the stopping point and subsequently traveling from the stopping point back to the first tower.

The first tower can include at least one platform and a cable connection point for connection of the at least one end of the at least one cable. An adjustment arrangement is operably coupled to the cable connection point to move the cable connection point relative to the base surface such that the at least end of the at least one cable is movable in elevation relative to the base surface.

In certain embodiments, the cable connection point is mounted to the at least one platform. The cable connection point can include a cross beam having a longitudinal axis that is generally parallel to a top surface of the at least one platform.

In certain embodiments, the adjustment arrangement includes a cable and pulley system, wherein the cable and pulley system includes a first pulley assembly mounted proximate the at least one tower, a second pulley assembly mounted on the at least one tower, and a cable routed from the first pulley assembly through the second pulley assembly and connected to the platform. The first pulley assembly is rotatable in a first direction to pay out the cable to lower the elevation of the cable connection point. The first pulley assembly is rotatable in a second direction opposite the first direction to increase the elevation of the cable connection point.

In certain embodiments, the adjustment arrangement includes a hydraulic cylinder operatively attached to the at least one platform to raise and lower the at least one platform.

In certain embodiments, the adjustment arrangement includes a plurality of rollers mounted on the at least one platform and connected to a vertical member of the first tower, wherein one or more of the plurality of rollers is connected to a drive arrangement for rotating the one or more plurality of rollers to cause the at least one platform to move relative to the vertical member.

In certain embodiments, the adjustment arrangement comprises an adjustment carriage, the adjustment carriage providing the cable connection point, and wherein the at least one platform includes multiple platforms, the adjustment carriage operably mounted to the first tower to selectively position the cable connection point adjacent each one of the multiple platforms.

In another aspect, the invention provides a tower for a zip line attraction with a movable cable connection point. A tower according to this aspect includes a support structure extending from a base surface with at least one platform connected to the support structure. The tower also includes a movable cable connection point positioned adjacent the support structure and movable in elevation relative to the base surface. A drive arrangement is operably connected to the movable connection point to selectively change the elevation thereof.

In certain embodiments according to this aspect, the cable connection point is mounted to the at least one platform. The cable connection point can include a cross beam having a longitudinal axis that is generally parallel to a top surface of the at least one platform.

In certain embodiments according to this aspect, the adjustment arrangement can include a cable and pulley system, wherein the cable and pulley system comprises a first pulley assembly mounted proximate the at least one tower, a second pulley assembly mounted on the at least one tower, and a cable routed from the first pulley assembly through the second pulley assembly and connected to the platform. The first pulley assembly is rotatable in a first direction to pay out the cable to lower the elevation of the cable connection point. The first pulley assembly is rotatable in a second direction opposite the first direction to increase the elevation of the cable connection point.

In certain embodiments according to this aspect, the adjustment arrangement includes a hydraulic cylinder operatively attached to the at least one platform to raise and lower the at least one platform.

In certain embodiments according to this aspect, the adjustment arrangement includes a plurality of rollers mounted on the at least one platform and connected to the support structure, wherein one or more of the plurality of rollers is connected to a drive arrangement for rotating the one or more plurality of rollers to cause the at least one platform to move relative to the vertical member.

In certain embodiments according to this aspect, the adjustment arrangement comprises an adjustment carriage, the adjustment carriage providing the cable connection point, and wherein the at least one platform includes multiple platforms, the adjustment carriage operably mounted to the first tower to selectively position the cable connection point adjacent each one of the multiple platforms. The adjustment carriage can include a plurality of rollers connected to the support structure.

In yet another aspect, the invention provides a method for operating a zip line attraction. A method according to this aspect includes connecting a user to a cable that is connected at a first end to a tower and at a second end to a stopping point. The method also includes sending the user from the tower to the stopping point along the cable. The method also includes changing the elevation of the first end of the cable and returning the user to the tower from the stopping point along the cable.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, FIGS. 1-8 illustrate various embodiments of a zip line attraction which, among several advantages, provides a zip line attraction that offers extended ride time to thereby increase user satisfaction, but does not require the relatively large amount of real estate required in a tour configuration. As will be explained in greater detail below a zip line attraction according to the teachings of the invention herein offers multiple trips between a tower and a general stopping point, which could be another identical or non-identical tower, and/or could be over land or water.

Figure 1:
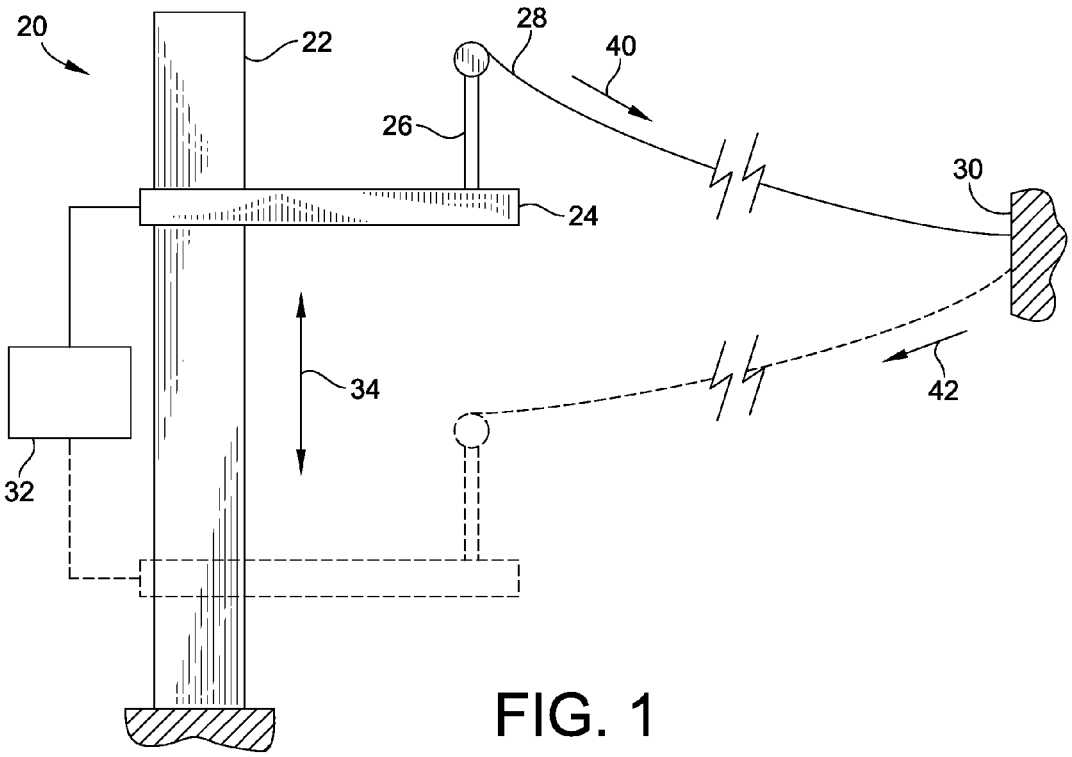
FIG. 1 is a schematic side view of an embodiment of a zip line attraction according to the teachings of the present invention.

With specific reference now to FIG. 1 one embodiment of a zip line tower 20 (referred to herein as a "tower") according to the teachings of the present invention is illustrated. Tower 20 includes a vertical member 22 and a platform 24 that incorporates a cable connection point 26. A cable 28 extends from cable connection point 26 to a stopping point 30. Stopping point 30 may be another identical or non-identical tower, and/or could be over land or water.

Cable connection point 26 may also comprise a generally horizontal cross beam which allows for multiple cables to extend therefrom in parallel to stopping point 30. As a result, multiple users may depart from platform 24 simultaneously. For purposes of brevity, the configuration and operation of embodiments described herein will be discussed in terms of a single cable; however, this should be taken to include multiple cables as well.

A platform adjustment arrangement 32 is operatively connected to platform 24. Platform adjustment arrangement 32 advantageously allows for the vertical adjustment of platform 24 along axis 34 to adjust the elevation of platform 24 relative to ground. Because cable 28 is fixed at one end to cable connection point 26, the end of cable 28 also has a variable elevation as a result of platform adjustment arrangement 30.

As described above, users connect to cable 28 proximate cable connection point 26 while standing on platform 24. In one mode of operation of tower 20, a user accesses platform 24 via stairs, ladders, etc. (not shown). Once on platform 24, a user then connects to cable 28, and travels along direction 40 until they reach stopping point 30. Although not shown, suitable braking means may be employed to slow the user down as they approach stopping point 30, and bring them to a complete stop once at stopping point 30.

Thereafter, platform adjustment arrangement 32 moves platform 24 downward along axis 34 to the alternate position shown in dashed lines in FIG. 1. As a result, the orientation of cable 28 also changes, causing the user, under gravity, to depart stopping point 30, travel along direction 42, and return to platform 22. Although not shown, suitable braking means may be employed to slow the user down as they approach platform 24, and bring them to a complete stop once at platform 24.

Thereafter, platform adjustment arrangement 32 may move platform 24 along axis 34 and back to its original position. A user can then repeat the aforementioned cycle. It will be recognized that the aforementioned operation allows for multiple trips between tower 20 and stopping point 30. This lengthens a user's overall ride time, and thereby will increase user satisfaction. Advantageously, however, this increase in user ride time does not come at the expense of a considerable amount of acreage, unlike prior tour designs. As such, businesses with a small amount of real estate can employ the configuration described herein and provide their patrons with a tour experience.

Figure 2:
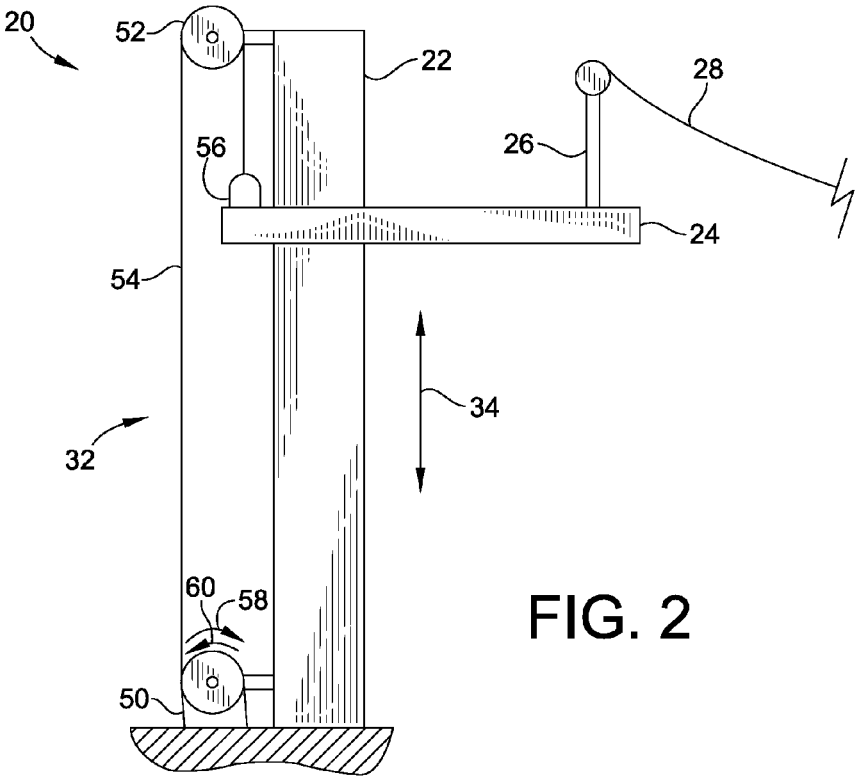
FIG. 2 is a side view of a tower of the zip line attraction of FIG. 1, employing one embodiment of a drive arrangement.
Figure 3:
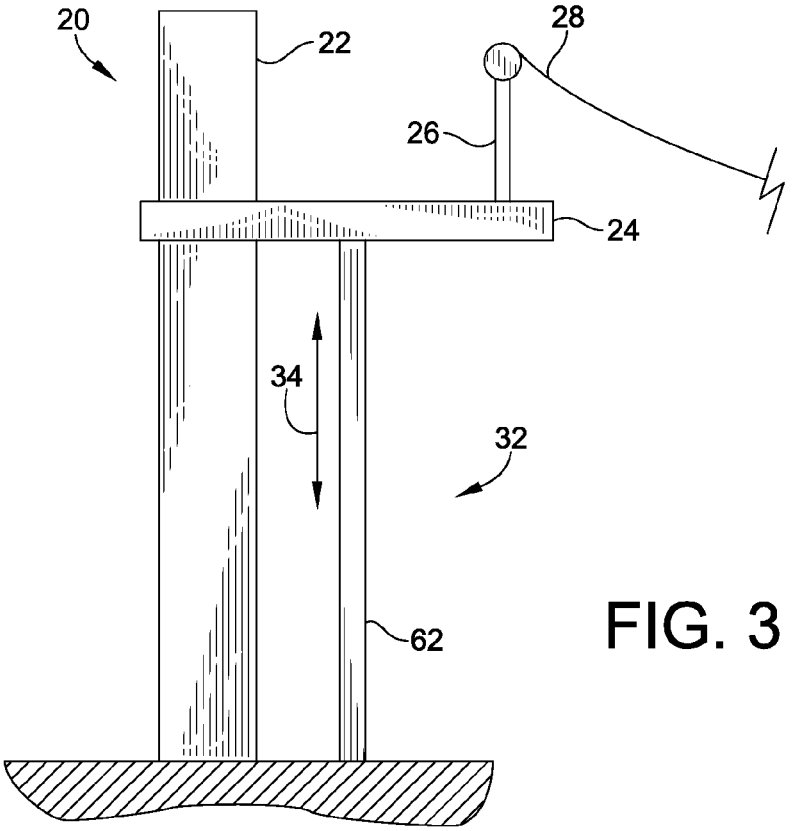
FIG. 3 is a side view of the tower of FIG. 1, depicting another embodiment of a drive arrangement of the tower.
Figure 4:
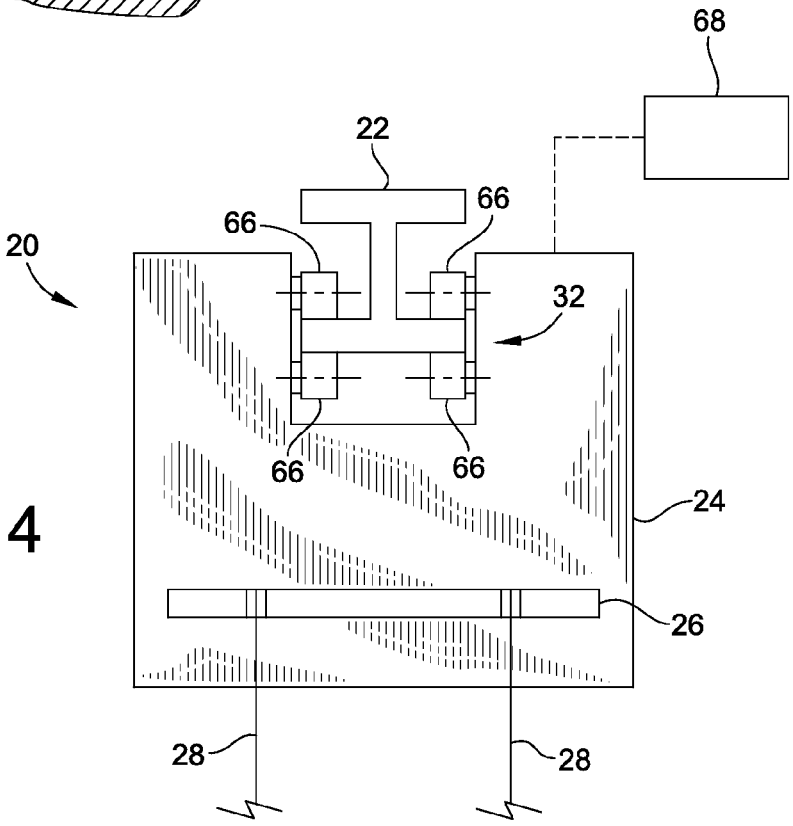
FIG. 4 is a top view of the tower of FIG. 1, depicting another embodiment of a drive arrangement of the tower.

FIGS. 2-4 show various embodiments of platform adjustment arrangement 32. With specific reference to FIG. 2, platform adjustment arrangement 32 may be embodied as a cable and pulley system. Such a system may incorporate a first pulley assembly 50, a second pulley assembly 52, and a cable 54 wound therebetween. One end of cable 54 is connected to first pulley 50, and a second end of cable 54 is connected to a connection point 56.

First pulley assembly 50 may be operatively connected to a motor for rotating first pulley assembly 50 in either of rotational directions 58, 60. Rotation of first pulley assembly 50 in rotational direction 58 will cause platform 24 to move downward along axis 34 to decrease the elevation thereof. Conversely, rotation of first pulley assembly 50 in rotational direction 60 will cause platform 24 to move upward along axis 34 to increase the elevation.

Turning now to FIG. 3, another embodiment of platform adjustment arrangement 32 is illustrated. In this embodiment, a hydraulic cylinder 62 is operatively attached to platform 24 and is operative to change the elevation of platform 24 along axis 34.

With reference to FIG. 4, another embodiment of a platform adjustment arrangement 32 is illustrated. Unlike the previous embodiments that incorporate an external platform adjustment arrangement 32, this embodiment incorporates an integrated platform adjustment arrangement 32 built directly into platform 24. Specifically, a plurality of rollers 66 may be employed to grip vertical member 22. Rollers 66 are operatively coupled to a drive arrangement 68 which rotates one or more of rollers 66 to cause platform 24 to "crawl" along vertical member 22. As can be seen from visual inspection of FIG. 4, vertical member 22 may take on various geometries to accommodate such functionality. In FIG. 4, vertical member 22 has a generally I-shaped cross section for example. Additionally, and instead of employing a pure roller arrangement as illustrated, a rack and pinion arrangement could also be employed, wherein one or more of rollers 66 is substituted with a pinion, and wherein a rack is provided on one face of vertical member 22 in meshed contact with the pinion.

Also illustrated in the top view of FIG. 4, is the multiple cable 28 embodiment of a cable connection point 26 as introduced above. As illustrated, multiple cables 28 extend from cable connection point 26. As such, users may depart together, one on each cable 28, from platform 24.

Figure 5:
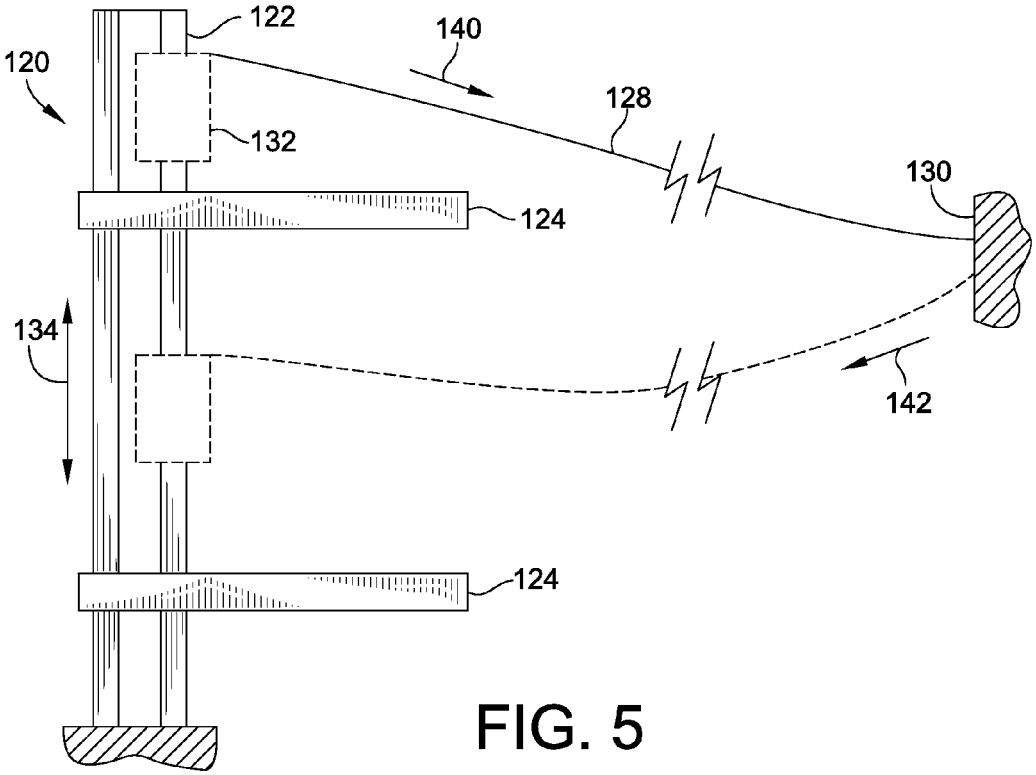
FIG. 5 is a side view of another embodiment of a tower for use with the zip line attraction, according to the teachings of the present invention.

Turning now to FIG. 5, another embodiment of a tower 120 is illustrated. Unlike tower 20 of FIGS. 1-4 which incorporates a movable platform 24, tower 120 utilizes fixed platforms 124 each attached to a vertical member 122. A cable connection carriage 132 is also mounted to vertical member 122. Cable connection carriage serves the purposes of both platform adjustment arrangement 32 and cable connection point 26 described above in that it provides a connection point for one end of a cable 128, and also a means for adjusting the elevation of an end point of cable 128 along axis 134. Similar to that described above, the other end of cable 128 is connected to a stopping point 130, which may be another identical or non-identical tower, and/or be over land or water.

In operation, a user accesses the uppermost platform 124 in FIG. 5, and connects to cable 128. The user then departs uppermost platform 124 and travels along cable 128 in direction 140 to stopping point 130. Just as in the prior embodiment, suitable braking means may be employed for slowing the user down as they approach stopping point 130, and stopping the user once at stopping point 130. Once at stopping point 130, cable connection carriage 132 then moves downwardly along vertical member 122 to position an end of cable 128 proximate the lowermost platform 124. Thereafter a user then departs stopping point 130 under gravity alone and travels along cable 128 in direction 142 until they reach lowermost platform 124. Suitable braking means may be employed for slowing the user down as they approach lowermost platform 124, and stopping the user once at lowermost platform 124.

Although only two platforms 124 are illustrated, it will be recognized that more than two platforms may be provided in other embodiments. Advantageously, cable connection carriage 132 can selectively position itself proximate each platform incorporated.

Figure 6:
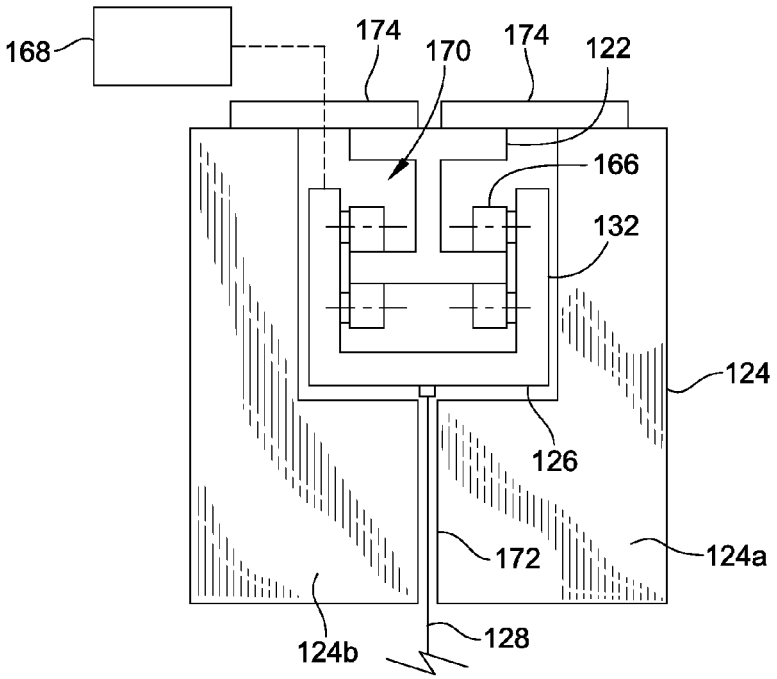
FIG. 6 is a top view of the tower of FIG. 5, depicting one embodiment of a drive arrangement of the tower.

Turning now to FIG. 6, a top view of one platform 124 is illustrated in proximity to one embodiment of cable connection carriage 132. Cable connection carriage 132 includes a frame 126 which effectively functions as a cable connection point for connection of cable 128. A plurality of rollers 166 are mounted to frame 126. Rollers 166 are connected to a drive arrangement 168 which selectively rotates one or more of rollers 166 to cause cable connection carriage 132 to "crawl" along vertical member 122 to move cable connection carriage along axis 134 (See FIG. 5). As was the case with the embodiment of FIG. 4, one or more of rollers 166 may be replaced with a pinion, and one or more corresponding faces of vertical member 122 may include a rack in meshed contact with the pinion.

In the embodiment of FIG. 6, visual inspection of platform 124 reveals that it is not identical to platform 24 described above. Particularly, platform 124 includes an aperture 170 and a gap 172 formed therethrough to effectively separate platform 124 into two identical halves 124*a*. 124*b*. Corresponding connection elements 174 are provided on each half 124*a*. 124*b* for connecting the same to vertical member 122.

As illustrated, aperture 170 provides sufficient clearance for the movement of cable connection carriage 132 relative to platform 124. Likewise, gap 172 provides sufficient clearance for the movement of cable 128 relative to platform 124.

Figure 7:
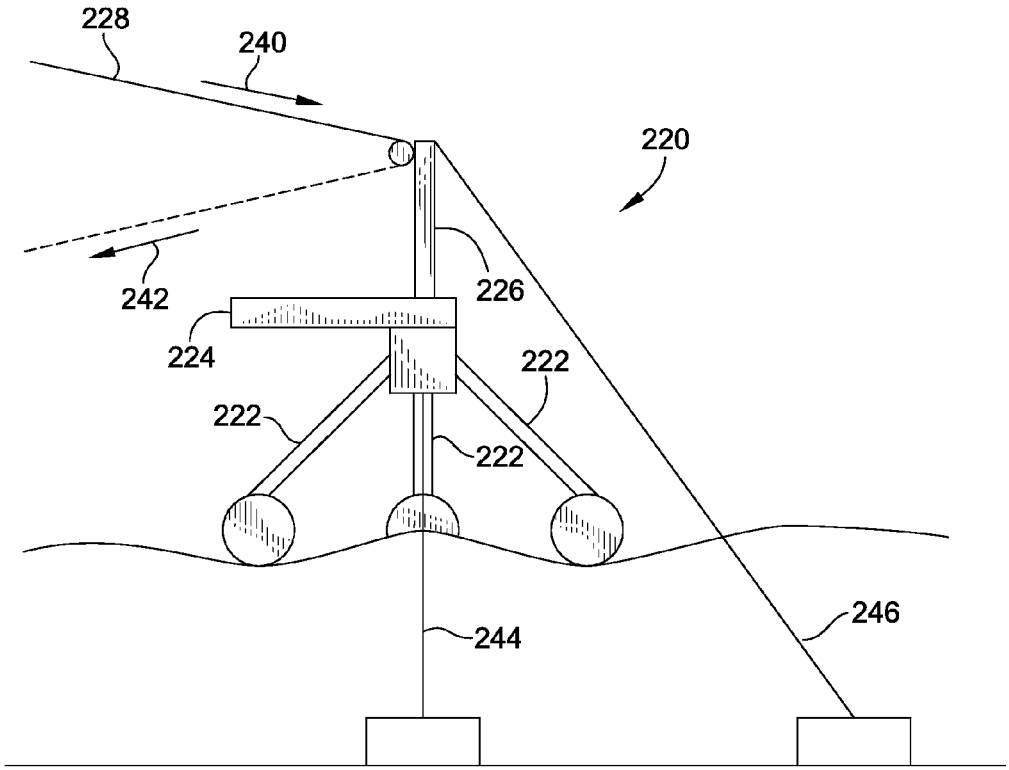
FIG. 7 is a side view of an over-water stopping point of the tower.

Turning now to FIG. 7, as introduced above stopping point 30, 130 may be another identical or non-identical tower, and/or may be positioned over land or water. FIG. 7 particularly illustrates a non-identical tower 220 which is floating in a body of water. One or more towers 20, 120 as described above may be positioned on land, e.g. a shoreline, and terminate at tower 220.

Tower 220 includes a plurality of floatation supports 222 that support a platform 224. A cable connection point 226 is mounted to platform 224. A cable 228 terminates at cable connection point 226.

Users arrive at tower 220 by traveling along cable 228 in direction 240, and depart tower 220 by traveling along cable 228 in direction 242. As such, tower 220 provides the functionality described above as stopping point 30, 130. However, given that tower 220 is positioned over water, it can incorporate anchoring elements 244, 246 for maintaining the general position of tower 220 and for maintaining the general vertical presentation of cable connection point 226.

Specifically, anchoring element 244 is connected to a central hub of floatation supports 222, and includes a mass at an end thereof for anchoring tower 220 in a general area in the water. Anchoring element 246 is connected to cable connection point 226 and includes a mass for anchoring connection point 226 in its general vertical orientation. More anchoring elements 224, 226 could be utilized depending on expected water turbulence, etc.

Figure 8:
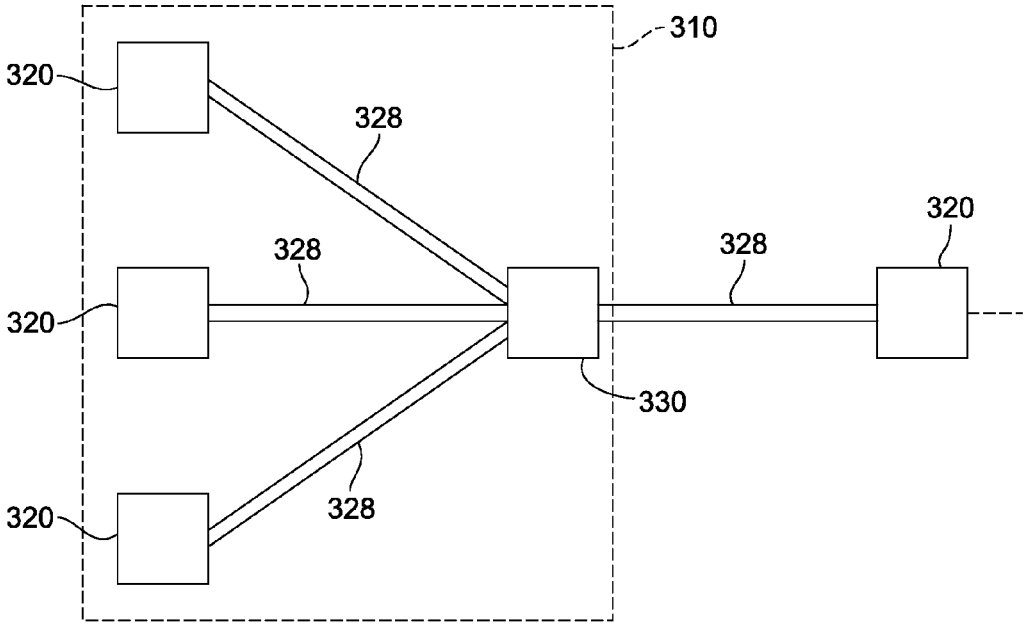
FIG. 8 is schematic top view of a course arranged in accordance with the teachings of the present invention.

In certain embodiments, multiple cable connection point 226 may be employed with tower 220 to allow for multiple towers as described above to terminate at tower 220 (See. e.g. FIG. 8). It will be recognized that this functionality is also possible over land, and in the context of stopping points 30, 130 described above. Further, in the context of the over-water configuration, a surprise release feature may be employed with the harness equipment for connecting the user to cable 228, such that as the user is traveling towards tower 220, an operator can trigger a release mechanism in the harness to drop the user into the body of water unexpectedly. This surprise release feature may operate electronically and wirelessly. It will be recognized that such a feature may also be incorporated over land, assuming the appropriate safety features are incorporated, e.g. netting, etc.

FIG. 8 illustrates a schematic layout of an embodiment of a course according to the teachings of the present invention. As shown, multiple towers 320 have cables 328 extending therefrom and which terminate at a common stopping point 330. Such a configuration advantageously allows for a tour configuration in a relatively small course space 310. Additional towers 320, may also be employed. FIG. 8 generally summarizes several of the advantages of the invention, in that users can enjoy extended ride times on a course space 310 that is much smaller than conventional layouts.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A zip line attraction, comprising;

a first tower extending from a base surface;

a stopping point;

at least one cable extending away from the first tower to the stopping point, and operable to carry a user thereon;

wherein at least one end of the at least one cable is movable in elevation relative to the base surface such that the user situated on the cable can depart from the first tower, travel along the first cable, and arrive at the stopping point and subsequently can depart froth the stopping point, travel along the first cable, and arrive at the first tower without disconnecting from the cable between traveling. from the first tower to the stopping point and subsequently traveling from the stopping point back to the first tower;

wherein the first tower includes at least one platform and a cable connection point for connection of the at least one end of the at least one cable;

further comprising an adjustment arrangement operably coupled to the cable connection point to move the cable connection point relative to the base surface such that the at least end of the at least one cable is movable in elevation relative to the base surface;

wherein the cable connection point is mounted to the at least one platform.

2. The zip line attraction of claim 1, wherein the cable connection point includes a cross beam having a longitudinal axis that is generally parallel to a top surface of the at least one platform.

3. The zip line attraction of claim 2, wherein the adjustment arrangement includes a cable and pulley system, wherein the cable and pulley system comprises a first pulley assembly mounted proximate the at least one tower, a second pulley assembly mounted on the at least one tower, and a cable routed from the first pulley assembly through the second pulley assembly and connected to the platform.

4. The zip line attraction of claim 3, wherein the first pulley assembly is rotatable in a first direction to pay out the cable to lower the elevation of the cable connection point, and wherein the first pulley assembly is rotatable in a second direction opposite the first direction to increase the elevation of the cable connection point.

5. The zip line attraction of claim 2, wherein the adjustment arrangement includes a hydraulic cylinder operatively attached to the at least one platform to raise and lower the at least one platform.

6. The zip line attraction of claim 2, wherein the adjustment arrangement includes a plurality of rollers mounted on the at least one platform and connected to a vertical member of the first tower, wherein one or more of the plurality of rollers is connected to a drive arrangement for rotating the one or more plurality of rollers to cause the at least one platform to move relative to the vertical member.

7. A tower for a zip line attraction, comprising:

a support structure extending from a base surface:

at least one platform connected to the support structure:

a movable cable connection point positioned adjacent the support structure and movable in elevation relative to the base surface:

an adjustment arrangement operably connected to the movable cable connection point to selectively charge the elevation thereof;

wherein the cable connection point is mounted to the at least one platform.

8. The tower of claim 7, wherein the cable connection point includes a cross beam having a longitudinal axis that is generally parallel to a top surface of the at least one platform.

9. The tower of claim 8, wherein the adjustment arrangement includes a cable and pulley system, wherein the cable and pulley system comprises a first pulley assembly mounted proximate the at least one tower, a second pulley assembly mounted on the at least one tower, and a cable routed from the first pulley assembly through the second pulley assembly and connected to the platform.

10. The tower of claim 8, wherein the adjustment arrangement includes a hydraulic cylinder operatively attached to the at least one platform to raise and lower the at least one platform.

11. The tower of claim 10, wherein the first pulley assembly is rotatable in a first direction to pay out the cable to lower the elevation of the cable connection point, and wherein the first pulley assembly is rotatable in a second direction opposite the first direction to increase the elevation of the cable connection point.

12. The tower of claim 8, wherein the adjustment arrangement includes a plurality of rollers mounted on the at least one platform and connected to the support structure, wherein one or more of the plurality of rollers is connected to a drive arrangement for rotating the one or more plurality of rollers to cause the at least one platform to move relative to the vertical member.

13. A method of operating a zip line attraction, comprising:

connecting a user to a cable that is connected at a first end to a tower and at a second end to a stopping point;

sending the user from the tower to the stopping point along the cable;

changing the elevation of the first end of the cable by adjusting an elevation of a platform of the tower; and returning the user to the tower from the stopping point along the cable.

* * * * *